US010842271B2

(12) United States Patent
Collins et al.

(10) Patent No.: US 10,842,271 B2
(45) Date of Patent: Nov. 24, 2020

(54) QUICK ASSEMBLY ARTICULATING EASEL

(71) Applicant: CRAYOLA, LLC, Easton, PA (US)

(72) Inventors: Scott Collins, Nazareth, PA (US); Douglas Brand, Easton, PA (US); Caleb Leaser, Apex, NC (US); Leena Vadaketh, Doylsetown, PA (US)

(73) Assignee: CRAYOLA, LLC, Easton, PA (US)

( * ) Notice: Subject to any disclaimer, the term of this patent is extended or adjusted under 35 U.S.C. 154(b) by 0 days.

(21) Appl. No.: 16/571,880

(22) Filed: Sep. 16, 2019

(65) Prior Publication Data

US 2020/0107639 A1 Apr. 9, 2020

Related U.S. Application Data

(60) Provisional application No. 62/742,710, filed on Oct. 8, 2018.

(51) Int. Cl.
*B68G 5/00* (2006.01)
*A47B 97/08* (2006.01)

(52) U.S. Cl.
CPC ..... *A47B 97/08* (2013.01)

(58) Field of Classification Search
CPC ..... A47B 97/08; A47B 97/04
See application file for complete search history.

(56) References Cited

U.S. PATENT DOCUMENTS

| | | | | |
|---|---|---|---|---|
| 2,376,063 A * | 5/1945 | Klick | A47B 97/08 248/464 |
| 4,098,009 A * | 7/1978 | Flynn | A47B 97/08 248/444.1 |
| 4,971,284 A * | 11/1990 | Curry | A47B 97/04 248/165 |
| D853,134 S * | 7/2019 | Zhang | D6/310 |
| 2001/0048059 A1* | 12/2001 | Jones, II | A47B 97/08 248/461 |

* cited by examiner

*Primary Examiner* — Amy J. Sterling
(74) *Attorney, Agent, or Firm* — Shook, Hardy and Bacon LLP

(57) ABSTRACT

Embodiments of the invention are directed to quick-assembly, articulating easel that moves from a planar orientation to an extended orientation with minimal manual manipulation. The easel components are movably interconnected, both in a compressed position during storage and in an extended position after assembly. The opposing writing surfaces of the easel may be oriented in upward positions parallel to the upward-facing bottom tray when in the compressed and/or disassembled position. Based on disengaging at least a portion of the interconnected easel components, such as by raising at least a portion of the easel components in an upward direction, the opposing writing surfaces may then be shifted in orientation to provide outward-facing writing surfaces in the assembled easel position. The articulating legs may then follow an arcuate curvature in travel between the various positions.

18 Claims, 6 Drawing Sheets

QUICK ASSEMBLY ARTICULATING EASEL

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief and at a high level, this disclosure describes, among other things, a quick-assembly articulating easel that moves from a planar orientation to an extended orientation with minimal manual manipulation. In some aspects, the easel components are movably interconnected, both in a compressed position during storage and in an extended position after assembly. The opposing writing surfaces of the easel may be oriented in upward positions parallel to the upward-facing bottom tray when in the compressed and/or disassembled position. Based on disengaging at least a portion of the interconnected easel components, such as by raising at least a portion of the easel components in an upward direction, the opposing writing surfaces may then be shifted in orientation to provide outward-facing writing surfaces in the assembled easel position.

Accordingly, embodiments of the invention include an easel system for quick setup, requiring minimal manual manipulation of each of the articulating portions of the easel with gravity impacting the outward folding of each writing surface and the leg extension process of each articulating easel leg, in a fluid motion from the planar/compressed orientation to the extended/assembled orientation.

DESCRIPTION OF THE DRAWINGS

Illustrative embodiments of the invention are described in detail below with reference to the attached drawing figures, and wherein.

DETAILED DESCRIPTION

Figure 1:
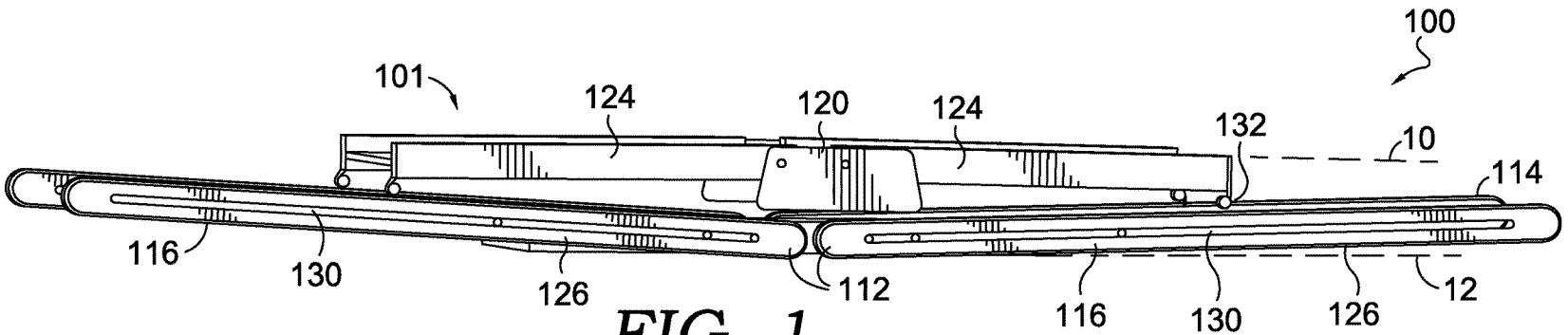
FIG. 1 is a side, folded view of the easel device in a disassembled configuration with the first and second writing surface components oriented in a common plane parallel to the plane of the bottom tray component, according to embodiments of the invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention include, among other things, a quick-assembly articulating easel that moves from a planar orientation to an extended orientation with minimal manual manipulation. In some aspects, the easel components are movably interconnected, both in a compressed position during storage and in an extended position after assembly. The opposing writing surfaces of the easel may be oriented in upward positions parallel to the upward-facing bottom tray when in the compressed and/or disassembled position. Based on disengaging at least a portion of the interconnected easel components, such as by raising at least a portion of the easel components in an upward direction, the opposing writing surfaces may then be shifted in orientation to provide outward-facing writing surfaces in the assembled easel position.

As such, without having to attach or detach portions of the easel components, the movably coupled writing surfaces and bottom tray may be quickly maneuvered from the compressed, disassembled orientation into the upright easel position. In further aspects, when in the compressed, disassembled position, the writing faces are oriented in a common plane, parallel to the bottom tray surface, while in the extended, assembled position, the writing faces are oriented at an angle with respect to each other, oriented in opposite directions along the easel legs in an assembled position. Further, corresponding to the travel of both of the writing surfaces from the compressed, parallel position to the upright, angled position, the easel legs may also transform from the compressed, closed position, to the elongated, open position.

In some embodiments, the bottom tray is moveably and continuously coupled to both easel legs throughout folding and unfolding of the easel components, whether collapsing or expanding the easel structure. In further aspects, the upper edges of each of the two opposed writing surfaces are continuously and moveably coupled to a common upper joint, while moved from the collapsed position to the expanded position. In some embodiments, the lower edge of each of the writing surfaces remains continuously, movably coupled to the easel legs throughout folding and unfolding of the easel components, moving between the compressed/folded orientation to the expanded/assembled position. As such, at least a portion of each of the easel's opposing writing surfaces and at least a portion of the bottom tray may be moveably coupled to the articulating legs of the easel via at least one travel aperture along the length of each easel leg.

In some embodiments of the articulating easel, the resulting, fluid assembly motion is associated with the minimal-force, upward movement of at least a portion of the easel components, which in association with other components movably coupled to the manipulated ones, causes each part of the easel to "pop" into place. For example, the manipulation of the two upward-facing writing surfaces into the outward facing easel locations may occur between interconnected easel components while maintaining a coupled configuration with respect to the easel frame, such as along the side rails of each easel leg. Further, according to the fluid assembly motion of the movably interconnected easel components, the first and second writing surfaces may be separated into moveable breakaway portions that disconnect and re-connect as solid writing surfaces. For example, the breakaway portion of the first and second writing surfaces may be configured such that the wingspan of the easel maintain a more compact orientation when disassembled, as does each of the extendable legs. Accordingly, embodiments of the invention also include an easel system for quick setup, requiring minimal manual manipulation of each of the articulating portions of the easel with gravity impacting the outward folding of each writing surface and the leg extension process of each articulating easel leg, in a fluid motion from the planar/compressed orientation to the extended/assembled orientation.

Figure 2:
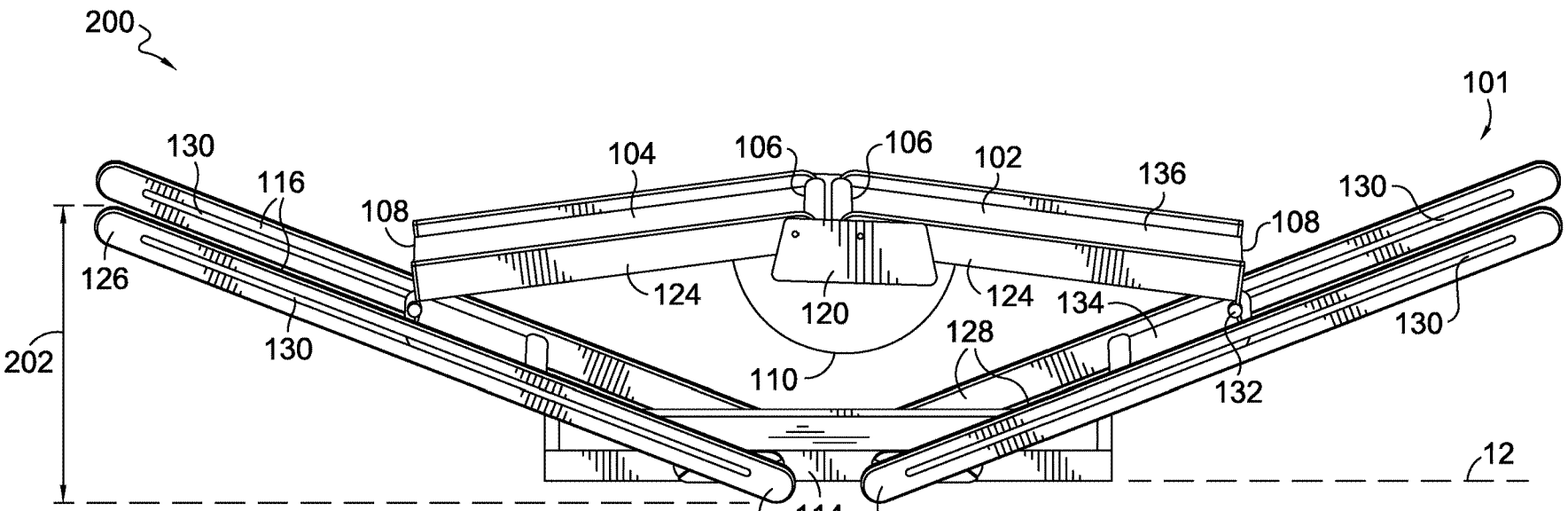
FIG. 2 is a partially elevated side view of the easel device in an first extending position, with the common upper joint elevated above the plane of the bottom tray component at a first height, according to embodiments of the invention.

Referring initially to FIG. 1, the side, folded view of the easel device 101 in a compressed position 100 includes a first writing surface component 102 and second writing surface component 104. Each of the first and second writing surface components 102 and 104 is oriented in a common plane 10 that is parallel to the plane 12 of the bottom tray component 114, according to embodiments of the invention. In further embodiments, based on the position of one or more components of the easel device 101, each of the first and second writing surface components 102 and 104, and the bottom tray component 114 may be positioned in separate, parallel planes, such as three parallel planes, thus compressing the overall size of the folded easel device 101 even further. In one aspect, as shown in FIG. 1, the easel device 101 comprises articulating and compact leg structures 116 that may be slidably engaged along the outer edges 124 of each of the first and second writing surface components 102 and 104 via an engagement component 118. The articulating and compact leg structures 116 may comprise a fixed portions 128 and an extendable portions 126. Such compression of each of the articulating and compact leg structures 116 may also be minimized by overlapping at least a portion of the extendable portions 126 with the fixed portions 128 of the articulating and compact leg structures 116 to further compact the easel device 101 in the compressed position 100. In the example of FIG. 1, the extendable portions 126 of the articulating and compact leg structures 116 are slidably engaged and/or are movably coupled to the hingedly connected first and second writing surfaces 102 and 104. As such, as shown in FIG. 2, the easel device 101 may be shifted into a first extended position 200 that is partially elevated, with the common upper joint 120 elevated above the plane 12 of the bottom tray component 114 at a first height 202 so that the bottom tray component 114 starts to transition into an intersecting position with respect to the first and second writing surface components 102 and 104, according to embodiments of the invention. In one aspect, the easel device 101 is shifted from the compressed position 100 of FIG. 1 into the first extended position 200 of FIG. 2 based on upward travel of at least one or more components of the easel device 101, such as the upper edge 106 of each of the first and second writing surface components 102 and 104, so that the first and second writing surface components start to be in an angled orientation, wherein an angle 110 formed between the first and second writing surface components 102 and 104 increasingly decreases as the easel device 101 is extended into a fully extended position, as will become more apparent based on the subsequent figures.

Figure 3:
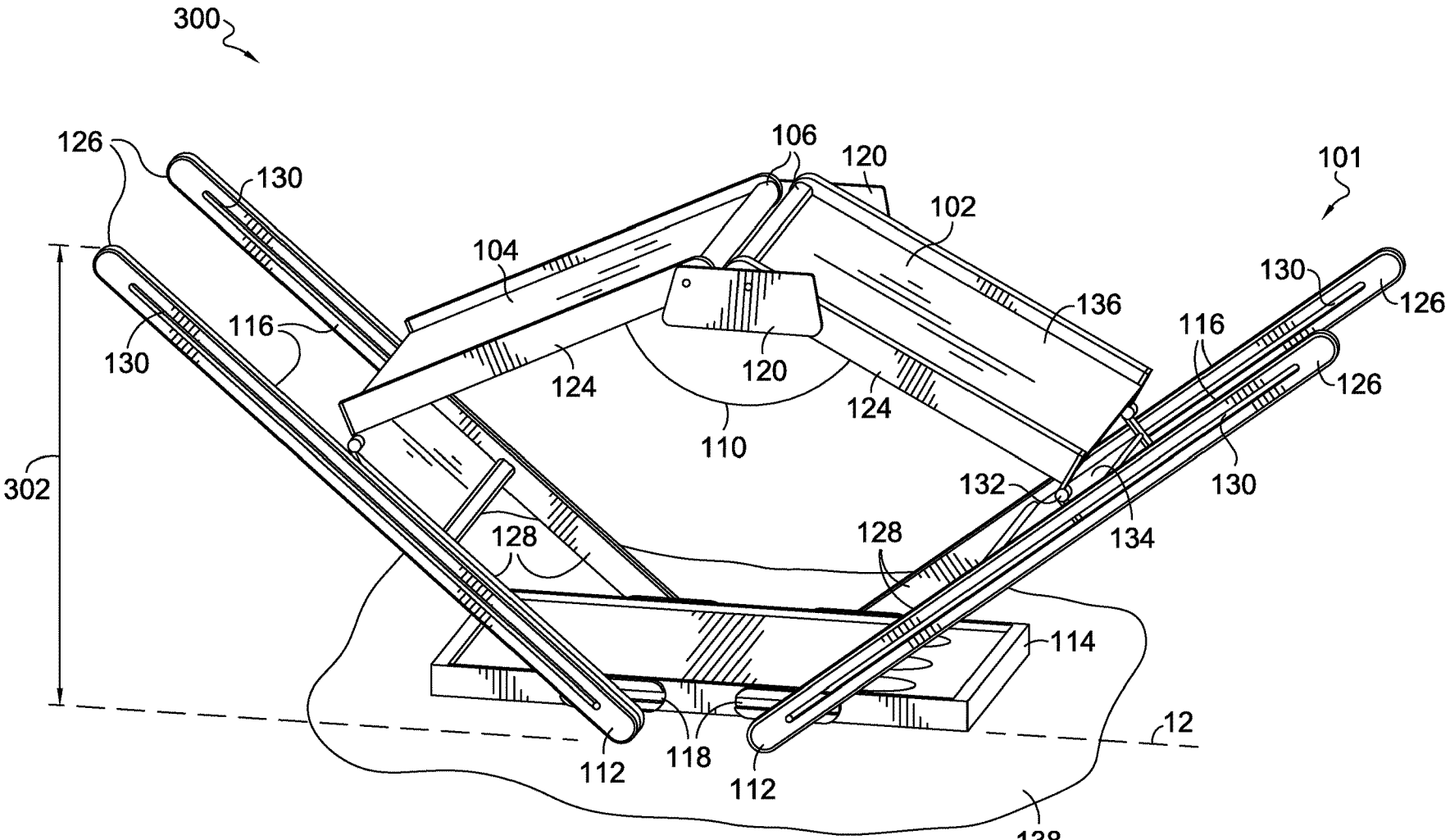
FIG. 3 is a partially elevated side view of the easel device in a second extended position, with the common upper joint elevated above the plane of the bottom tray component at a second height greater than the first height, according to embodiments of the invention.

In FIG. 3, the movably coupled components of the easel device 101 are further shifted into a second extended position 300, with the common upper joint 120 elevated above the plane 12 of the bottom tray component 114 at a second height 302 greater than the first height 202, according to embodiments of the invention. In some aspects, the lower edge 108 of each of the first and second writing surface components 102 and 104 may travel along the aperture 130 (i.e. tracks) of each of the extendable portions 126 of the articulating and compact leg structures 116, such that a tab feature 132 coupled to the lower edge 108 of each of the first and second writing surface components 102 and 104 engages along the aperture 130 of each of the extendable portions 126 of the articulating and compact leg structures 116. In further aspects, the tab feature 132 coupled to the lower edge 108 of each of the first and second writing surface components 102 and 104, may be slidably engaged with the aperture 130 of the extendable portions 126 such that travel along the extendable portions 126 by each tab feature 132 facilitates extension of the articulating and compact leg structures 116 into an outward position, and the manipulation of the first and second writing surface components 102 and 104 into mirrored, outward positions, and overall consistent maneuvering of the easel device 101 during expansion of the easel device 101. In further embodiments, each of the first and second writing surface components 102 and 104 may include one or more tab features 132 along the outer edges 124 of each of the first and second writing surface components 102 and 104, configured to engage with at least one aperture 130 on at least one articulating and compact leg structure 116. In further embodiments, each writing surface component may include a single planar surface, or a separable planar surface having hinged components that further compress the overall size of the disassembled easel. For example, each of the first writing surface component 102 and second writing surface component 104 may include a breakaway lower portion 134 that is hingedly fixed to an upper portion 136 of each of the first and second writing surface components 102 and 104, with the breakaway lower portion 134 folding into a parallel configuration with the upper portion 136 when the easel device 101 is compressed, and extending into the same plane as the upper portion 136 in a fully extended and outward-facing configuration.

Figure 5:
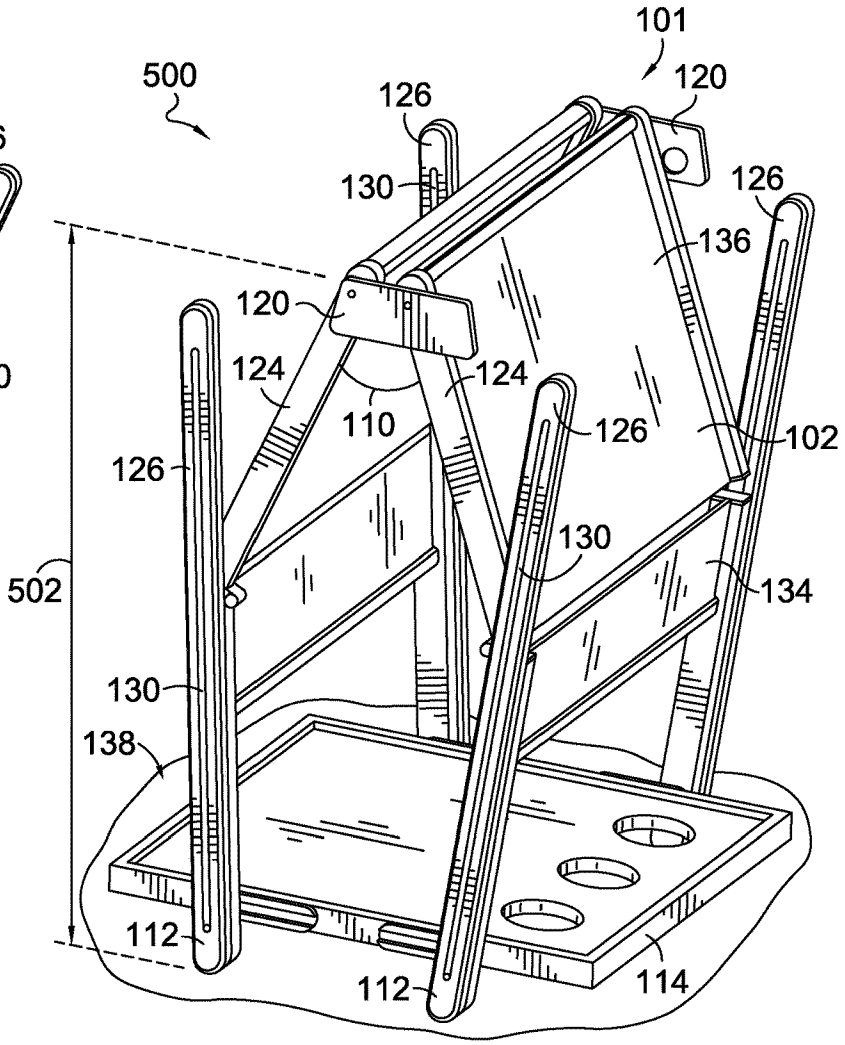
FIG. 5 is a partially elevated side view of the easel device in a fourth extended position, with the common upper joint elevated above the plane of the bottom tray component at a fourth height greater than the first, second, and third heights, according to embodiments of the invention.
Figure 4:
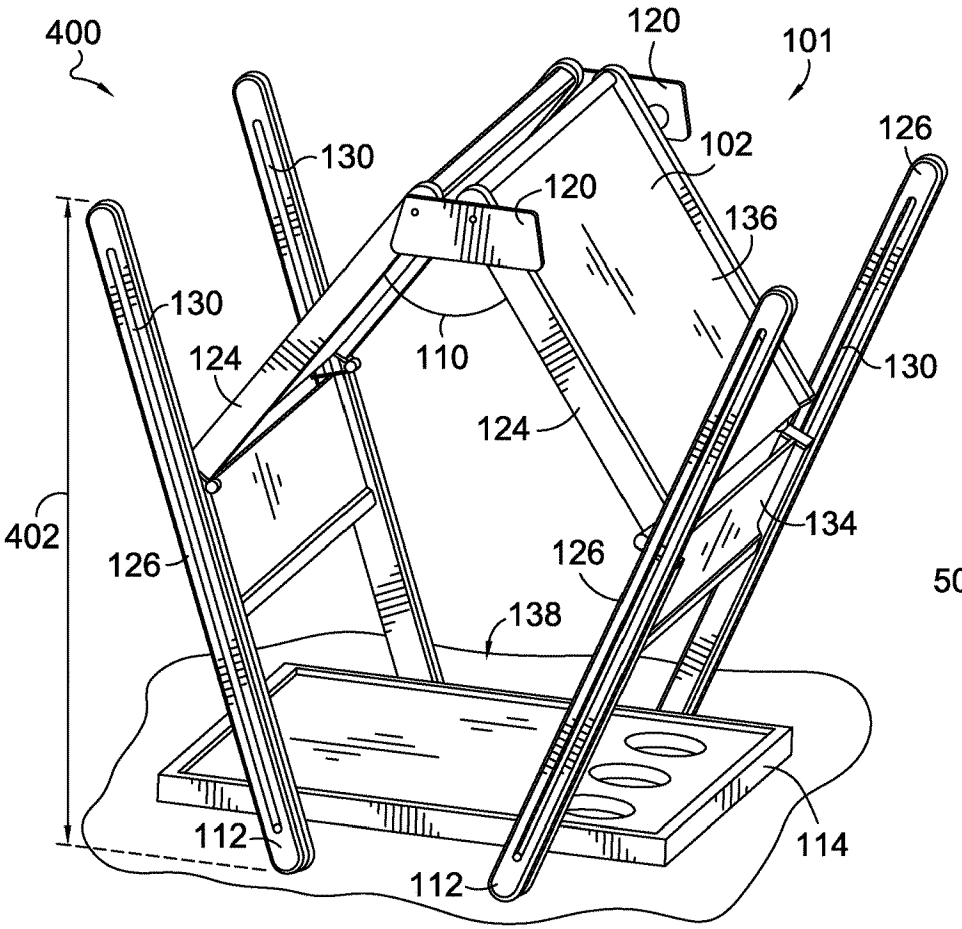
FIG. 4 is a partially elevated side view of the easel device in a third extended position, with the common upper joint elevated above the plane of the bottom tray component at a third height greater than the first and second heights, according to embodiments of the invention.

Continuing with FIG. 4, a partially elevated side view of the easel device 101 is shown in an exemplary third extended position 400, with the common upper joint 120 elevated above the plane 12 of the bottom tray component 114 at a third height 402 greater than the first height 202 and second height 302, according to embodiments of the invention. In the example of FIG. 4, the end portion 112 of each extendable portions 126 of each articulating and compact leg structure 116 may be resting on a solid surface 138, such as a floor, such that travel of the extendable portions 126 and the fixed portions 128 is not yet activated, but travel of each of the first and second writing surface components 102 and 104 is continuing. Accordingly, in FIG. 5, view of the easel device in a fourth extended position 500, with the common upper joint 120 elevated above the plane 12 of the bottom tray component 114 at a fourth height 502 that is greater than the first height 202, the second height 302, and the third height 402, according to embodiments of the invention. In the example of FIG. 5, without having shifted the position of the bottom tray component 114, each of the first and second writing surface components 102 and 104 have almost fully articulated into outward facing positions, the upper edge 106 of each first and second writing surface component 102 and 104 has reached a higher elevation relative to the bottom tray component 114, and the hinged portions of each of the first and second writing surface components 102 and 104 are progressing toward a common plane joining the upper portions 136 and the breakaway lower portions 134 of each of the first and second writing surface components 102 and 104.

Figure 6:
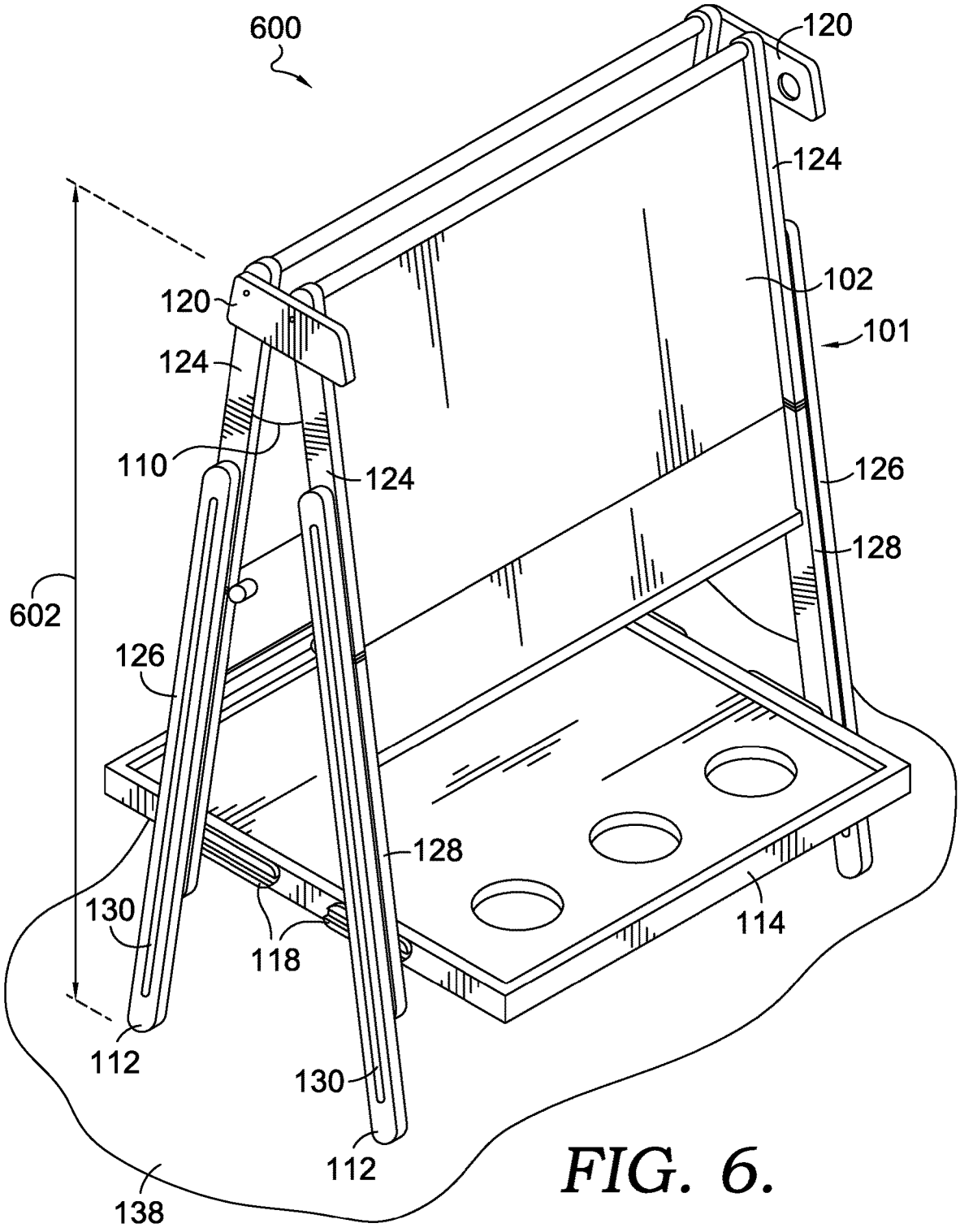
FIG. 6 is a partially elevated side view of the easel device in a fifth extended position having writing surfaces shifted into alignment with the easel legs, and with the common upper joint elevated above the plane of the bottom tray component at a fifth height greater than the first, second, third, and fourth heights, according to embodiments of the invention.
Figure 7:
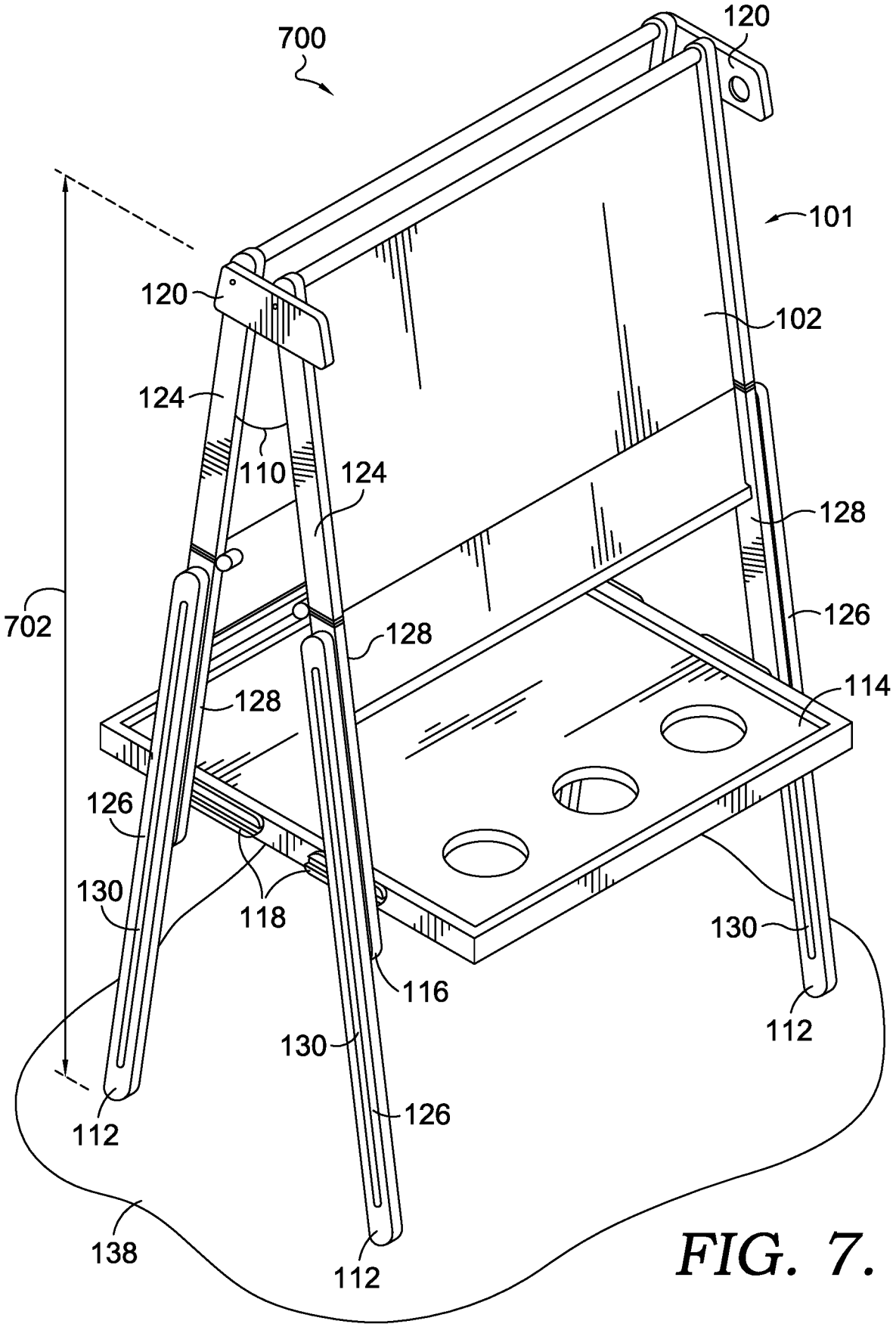
FIG. 7 is a partially elevated side view of the easel device in a sixth extended position having the legs extending from a retracted to a partially extended position, elongating the body of each leg component, according to embodiments of the invention.
Figure 8:
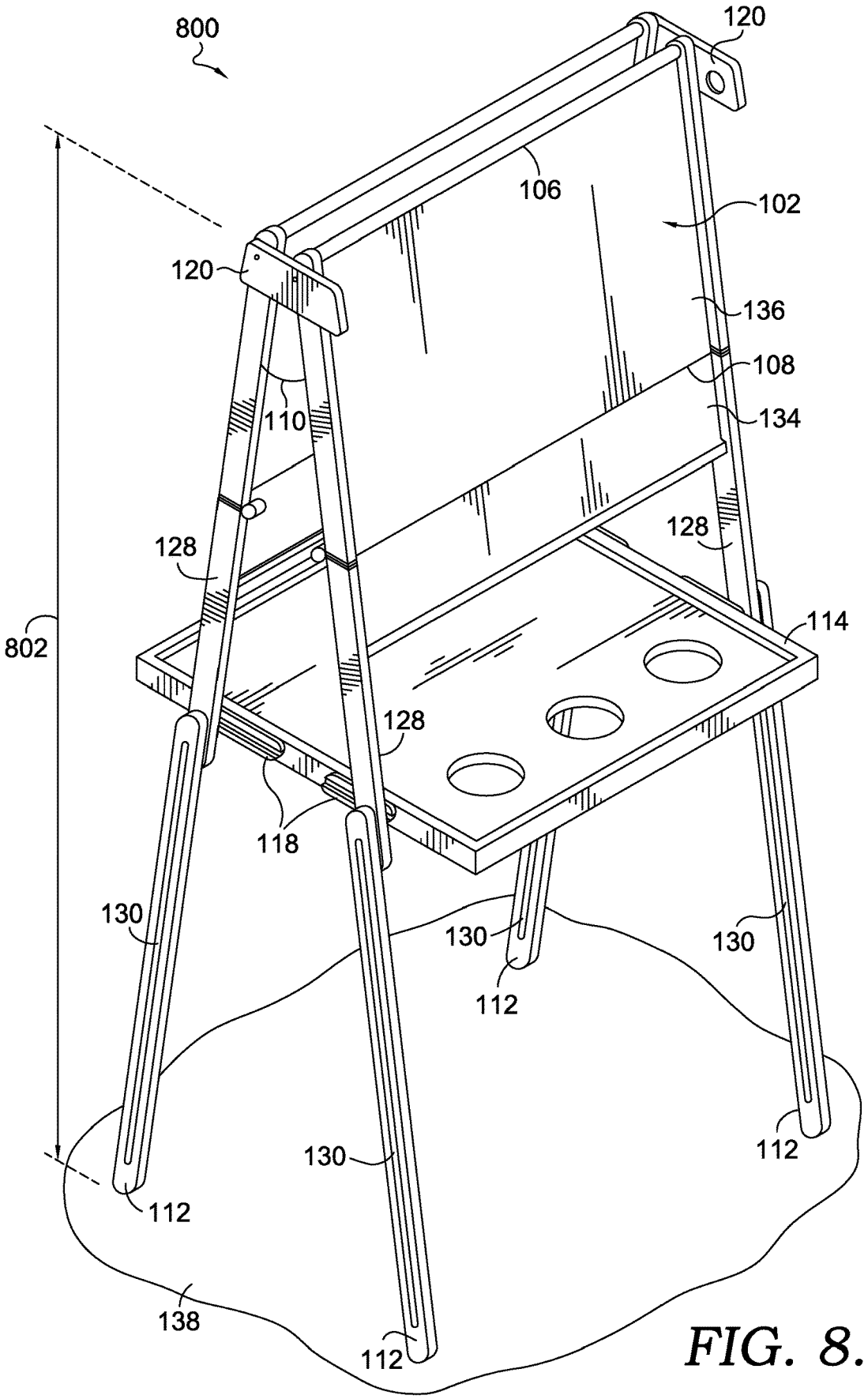
FIG. 8 is a side view of the fully elevated easel structure, having the leg components in fully extended positions, in accordance with embodiments of the invention.

Accordingly, in the example of FIG. 6, a partially elevated side view of the easel device in a fifth extended position 600 having first and second writing surface components 102 and 104 shifted into alignment with the articulating and compact leg structures 116, and with the common upper joint 120 elevated above the plane 12 of the bottom tray component 114 at a fifth height 602 that is greater than the first height 202, the second height 302, the third height 402, and the fourth height 502, according to embodiments of the invention. In the example of FIG. 6, having elevated the upper edge 106 of each first and second writing surface component 102 and 104 into a highest position above the bottom tray component 114, each articulated and compact leg structure 116 of the easel device 101 is also shifted into alignment along the outer edges 124 of each first and second writing surface component 102 and 104. Accordingly, in FIG. 7, the easel device is in a sixth extended position 700 having the articulating and compact leg structures 116 extending from a retracted to a partially extended position at a sixth height 702 that is greater than the first height 202, the second height 302, the third height 402, the fourth height 502, and the fifth height 602, elongating the body of each articulating and compact leg structure 116, according to embodiments of the invention. Based on raising and lowering of the overall easel device 101, and in response to the force of gravity acting on each extendable portions 126 of the articulating and compact leg structures 116, each of the articulating and compact leg structures 116 may then extend further downward, in to the view of the fully extended position 800 in FIG. 8 at a seventh height 802 that is greater than the first height 202, the second height 302, the third height 402, the fourth height 502, the fifth height 602, and the sixth height 702, with the fully elevated easel device 101 having the extendable portions 126 of each articulating and compact leg structure 116 being in fully extended positions, in accordance with embodiments of the invention.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. An easel device comprising:

a first writing surface component having a first upper edge and a first lower edge;

a second writing surface component having a second upper edge and a second lower edge;

a bottom tray component, wherein the bottom tray component is configured to move from a parallel orientation with respect to each of the first writing surface component and the second writing surface component when the easel device is in a compressed position, to an intersecting orientation with respect to each of the first writing surface component and the second writing surface component when the easel device is in an expanded position, wherein the bottom tray component is proximate the first lower edge of the first writing surface component and the second lower edge of the second writing surface component when the easel device is in the expanded position, wherein the easel device is configured to move from the compressed position to the expanded position based on an upward travel of the first upper edge of the first writing surface component and the second upper edge of the second writing surface component;

a first pair of compact leg structures moveably coupled to the first writing surface and a first portion of the bottom tray component; and a second pair of compact leg structures movably coupled to the second writing surface component and a second portion of the bottom tray component.

2. The easel device of claim 1, wherein the first writing surface component is comprised of a first upper portion and a first breakaway lower portion, and the second writing surface component is comprised of a second upper portion and second breakaway lower portion.

3. The easel device of claim 2, wherein each compact leg structure of the first pair of compact leg structures and the second pair of compact leg structures is comprised of an extendable portion and a fixed portion.

4. The easel device of claim 3, wherein the first pair of compact leg structures and the second pair of compact leg structures are configured to slidably compress and extend along a longitudinal axis of opposing sides of the first writing surface component and the second writing surface component.

5. The easel device of claim 3, wherein the fixed portion of the each compact leg structure is coupled to a respective outer edge of the first writing surface component and a respective outer edge of the second writing surface component.

6. The easel device of claim 3, wherein the extendable portion of the each compact leg structure is coupled to the bottom tray component via an engagement component.

7. The easel device of claim 1, wherein the first writing surface component and the second writing surface component are joined by a first common upper joint and a second common upper joint proximate to the first upper edge and the second upper edge of the first writing surface component and the second writing surface component, respectively.

8. The easel device of claim 1, wherein the second writing surface component is oriented in a planar orientation with respect to the first writing surface component in the compressed position, and further wherein the second writing surface component is oriented in an angled orientation opposite the first writing surface component in the expanded position.

9. The easel device of claim 1, wherein the easel device is configured to move between the compressed position and the expanded position based on an upward travel of an upper portion of each of the first and second writing surface components.

10. An easel device:

a plurality of coupled easel components comprising:

a writing surface component coupled to a compact leg structure; and a bottom tray component also coupled to the compact leg structure;

wherein the plurality of coupled easel components are configured to transition between a compressed position to an expanded position, wherein the transition from the compressed position to the expanded position corresponds to an upward vertical displacement of an upper edge of the writing surface component with respect to a surface, and wherein the upward vertical displacement is orthogonal to a plane of the surface.

11. The easel device of claim 10, wherein the compact leg structure is comprised of an extendable portion and a fixed portion.

12. The easel device of claim 10, wherein the compact leg structure is configured to slidably compress and extend along a longitudinal axis of opposing sides of the writing surface component.

13. A quick-assembly easel system slidably engaging between a compressed position and an expanded position, the easel system comprising:

at least two slidably engaged pairs of compact leg structures;

at least two upper writing surface components coupled to the at least two slidably engaged pairs of compact leg structures; and at least one bottom tray component coupled to each of the at least two slidably engaged pairs of compact leg structures and at least two writing surface components, wherein the quick-assembly easel system is configured to move from the compressed position to the expanded position based on an upward travel of an upper edge of each of the at least two upper writing surface components.

14. The quick-assembly easel system of claim 13, wherein the at least two upper writing surface components are parallel to the at least one bottom tray component in the compressed position, and wherein the at least two upper writing surface components are at a bisecting angle with respect to the bottom tray component in the expanded position.

15. The quick-assembly easel system of claim 13, wherein each of the at least two slidably engaged pairs of compact leg structures are comprised of an extendable portion and a fixed portion.

16. The easel device of claim 15, wherein the extendable portion of each of the at least two slidably engaged pairs of compact leg structure is coupled to the bottom tray component via an engagement component.

17. The quick-assembly easel system of claim 13, wherein each of the at least two upper writing surface components are comprised of an upper portion and a breakaway lower portion.

18. The quick-assembly easel system of claim 13, wherein the at least two upper writing surface components are joined by a first common upper joint and a second common upper joint proximate to the upper edge of each of the at least two writing surface components.

* * * * *